US008533866B1

(12) United States Patent
Lindquist

(10) Patent No.: US 8,533,866 B1
(45) Date of Patent: Sep. 17, 2013

(54) ARTICLE HAVING AN IMPROVED CLOSURE DEVICE

(75) Inventor: John Lindquist, Liberty, NC (US)

(73) Assignee: VF Jeanswear Limited Partnership, Greensboro, NC (US)

( * ) Notice: Subject to any disclaimer, the term of this patent is extended or adjusted under 35 U.S.C. 154(b) by 2321 days.

(21) Appl. No.: 11/137,813

(22) Filed: May 25, 2005

(51) Int. Cl.
*A41D 3/02* (2006.01)

(52) U.S. Cl.
USPC ..... 2/96

(58) Field of Classification Search
USPC ..... 24/40, 429, 546; 2/96, 79, 227, 2/76, 141.1, 141.2
See application file for complete search history.

(56) References Cited

U.S. PATENT DOCUMENTS

| | | | | |
|---|---|---|---|---|
| 141,484 | A | 8/1873 | Brientnall | 24/379.1 |
| 277,181 | A | 5/1883 | Witsil | 24/40 |
| 322,284 | A | 7/1885 | Havell | 24/40 |
| 349,415 | A | 9/1886 | Taylor | 24/40 |
| 368,024 | A | 8/1887 | Smith | 24/40 |
| 639,442 | A | 12/1899 | Salisbury | 24/40 |
| 1,074,905 | A | 10/1913 | Smith | 24/40 |
| 1,205,663 | A | 11/1916 | Reid | 24/40 |
| 1,343,096 | A | 6/1920 | Speyer | 24/378.1 |
| 1,558,370 | A | 10/1925 | Kelley | 24/379.1 |
| 2,060,643 | A | 11/1936 | Steele | 24/578.11 |
| 2,983,006 | A | 5/1961 | Schafer | 24/378.1 |
| 3,127,651 | A | 4/1964 | Foose et al. | 24/378.1 |
| 3,683,459 | A | 8/1972 | Johansen | 24/40 |
| D240,669 | S | 7/1976 | Pifer | D2/643 |
| 4,043,006 | A | 8/1977 | Williams et al. | 24/114.8 |
| 4,942,646 | A | 7/1990 | Sebastian | 24/40 |
| 5,276,948 | A | 1/1994 | Steadman | 24/40 |
| 5,347,688 | A | 9/1994 | Ross | 24/40 |
| 5,732,447 | A | 3/1998 | Nolen et al. | 24/40 |
| 5,855,401 | A | 1/1999 | Papernik | 294/2 |
| 6,032,996 | A | 3/2000 | Kogen | 294/2 |
| 6,446,312 | B1 | 9/2002 | Kabat | 24/40 |
| 6,550,109 | B2 | 4/2003 | Sims | 24/40 |
| 6,578,397 | B1 | 6/2003 | Altrich et al. | 70/408 |
| 6,704,973 | B1 | 3/2004 | Naham | 24/40 |

*Primary Examiner* — Tejash Patel
(74) *Attorney, Agent, or Firm* — MacCord Mason PLLC

(57) ABSTRACT

An article having an improved closure device. The article includes an opening including: (i) an overlapping portion with a receiving aperture; and (ii) an underlying surface; and (b) an asymmetrically offset fastener attached to the underlying surface of the article for fastening the underlying surface to the overlapping portion, wherein the asymmetrically offset fastener is dimensionally greater in one direction than in the other direction with respect to the aperture.

75 Claims, 7 Drawing Sheets

ARTICLE HAVING AN IMPROVED CLOSURE DEVICE

BACKGROUND OF THE INVENTION (1) Field of the Invention

The present invention relates generally to apparel and, more particularly, to an article having an improved closure device permanently affixed to the article to enable easier buttoning of various articles having button fasteners.

(2) Description of the Prior Art

Traditionally, small children and arthritic or disabled adults have been unable to use buttons because of the dexterity needed to pull a small button through a hole. Therefore, people who needed help fastening buttons on clothing, bags, covers, and other articles having openings relied on hook-like buttoning tools, which are well known in the art, to aid in pulling a button through a buttonhole. Such tools usually had a relatively stiff hook attached to a handle. A person would guide the hook through a buttonhole to ensnare the button. The tool was then pulled to bring the button through the buttonhole. However, these devices were simply tools that could be misplaced or had to be carried around to be convenient. Also, the tools may be difficult for small children to use as a certain amount of dexterity is still needed to insert the hook through a buttonhole in the first place. Also, it can be difficult to hook a flat button that is tightly sewn onto a garment.

Thus, there remains a need for a new and improved article having an improved closure device that is both permanently affixed to the item needing fastening and relatively easy for small children or disabled adults to use.

SUMMARY OF THE INVENTION

The present invention is directed to an article having an improved closure device. The improved closure device may include an opening having a garment body and an asymmetrically offset fastener attached to the underlying surface of the opening for fastening the underlying surface to the overlapping portion. In a preferred embodiment, the opening may include: (i) an overlapping portion with a receiving aperture and (ii) an underlying surface. The asymmetrically offset fastener may be dimensionally greater in one direction than in the other direction with respect to the aperture, and may also include an attachment device for permanently affixing the asymmetrically offset fastener to the underlying surface of the article and a shell portion adjacent to the opening.

The article having an improved closure may further include a shell portion adjacent to the opening. The overlapping portion of the shell may be a pocket.

The shell may also be a garment body. The garment body may be a garment bottom such as a pair of pants, a garment top such as a blouse or a coat, or a pair of gloves. The shell may also be a tote such as a book bag or a protective covering such as a tarp.

Preferably, the asymmetrically offset fastener includes indicia on at least one surface of the asymmetrically offset fastener. Also, the asymmetrically offset fastener may include a tactile aid on at least one surface. The tactile aid may be a notch along one edge of the asymmetrically offset fastener for aiding finger positioning. In a preferred embodiment, the asymmetrically offset fastener includes a decorative embellishment attached to the distal end. The distal end of the asymmetrically offset fastener may also be adapted for receiving a pull. Preferably, the adaptation for receiving a pull may be an aperture. The aperture may be elongated in the direction perpendicular to the longitudinal axis of the asymmetrically offset fastener. Also preferably, the adaptation for receiving a pull is a portion adjacent to the distal end.

In another embodiment, the asymmetrically offset fastener may include at least one piece formed with an interior groove adapted to receive an existing button on the article. Also preferably, the asymmetrically offset fastener is a two-piece fastener adapted to attach to an existing button on the article. The two-piece fastener may include a split chevron for receiving the button and a sheath for closing the split chevron, thereby permanently affixing the asymmetrically offset fastener to the underlying surface of the article. Alternatively, the asymmetrically offset fastener may be a one-piece fastener adapted to attach to an existing button on the article. The one-piece fastener may include an elongated loop with at least one interior locking tab for permanently affixing the asymmetrically offset fastener to the underlying surface of the article. In another embodiment, the one-piece fastener may include an elongated loop with at least one exterior locking tab for permanently affixing the asymmetrically offset fastener to the underlying surface of the article.

In a preferred embodiment, the attachment device for permanently affixing the asymmetrically offset fastener to the underlying surface of the article is a male/female attachment. The female portion of the attachment device may be an aperture in the asymmetrically offset fastener, while the male portion of the attachment device may be a protrusion on the asymmetrically offset fastener. Preferably, the male/female attachment device may be a post and rivet, a plastic tag, or by sewing.

Accordingly, one aspect of the present invention is to provide an article having an improved closure device. The article having an improved closure device may include (a) an opening including: (i) an overlapping portion with a receiving aperture; and (ii) an underlying surface; and (b) an asymmetrically offset fastener attached to the underlying surface of the article for fastening the underlying surface to the overlapping portion, wherein the asymmetrically offset fastener is dimensionally greater in one direction than in the other direction with respect to the aperture.

Another aspect of the present invention is to provide an article having an improved closure device. The improved closure device may include: (a) an opening including: (i) an overlapping portion with a receiving aperture; and (ii) an underlying surface; (b) an asymmetrically offset fastener attached to the underlying surface of the article for fastening the underlying surface to the overlapping portion, wherein the asymmetrically offset fastener is dimensionally greater in one direction than in the other direction with respect to the aperture; and (c) an attachment device for permanently affixing the asymmetrically offset fastener to the underlying surface of the article.

Still another aspect of the present invention is to provide an article having an improved closure device. The article having an improved closure device may include: (a) an opening having a garment body including: (i) an overlapping portion with a receiving aperture; and (ii) an underlying surface; (b) an asymmetrically offset fastener attached to the underlying surface of the article for fastening the underlying surface to the overlapping portion, wherein the asymmetrically offset fastener is dimensionally greater in one direction than in the other direction with respect to the aperture; (c) an attachment device for permanently affixing the asymmetrically offset fastener to the underlying surface of the article; and (d) a shell portion adjacent to the opening.

These and other aspects of the present invention will become apparent to those skilled in the art after a reading of the following description of the preferred embodiment when considered with the drawings.

DESCRIPTION OF THE PREFERRED EMBODIMENTS

Figure 1:
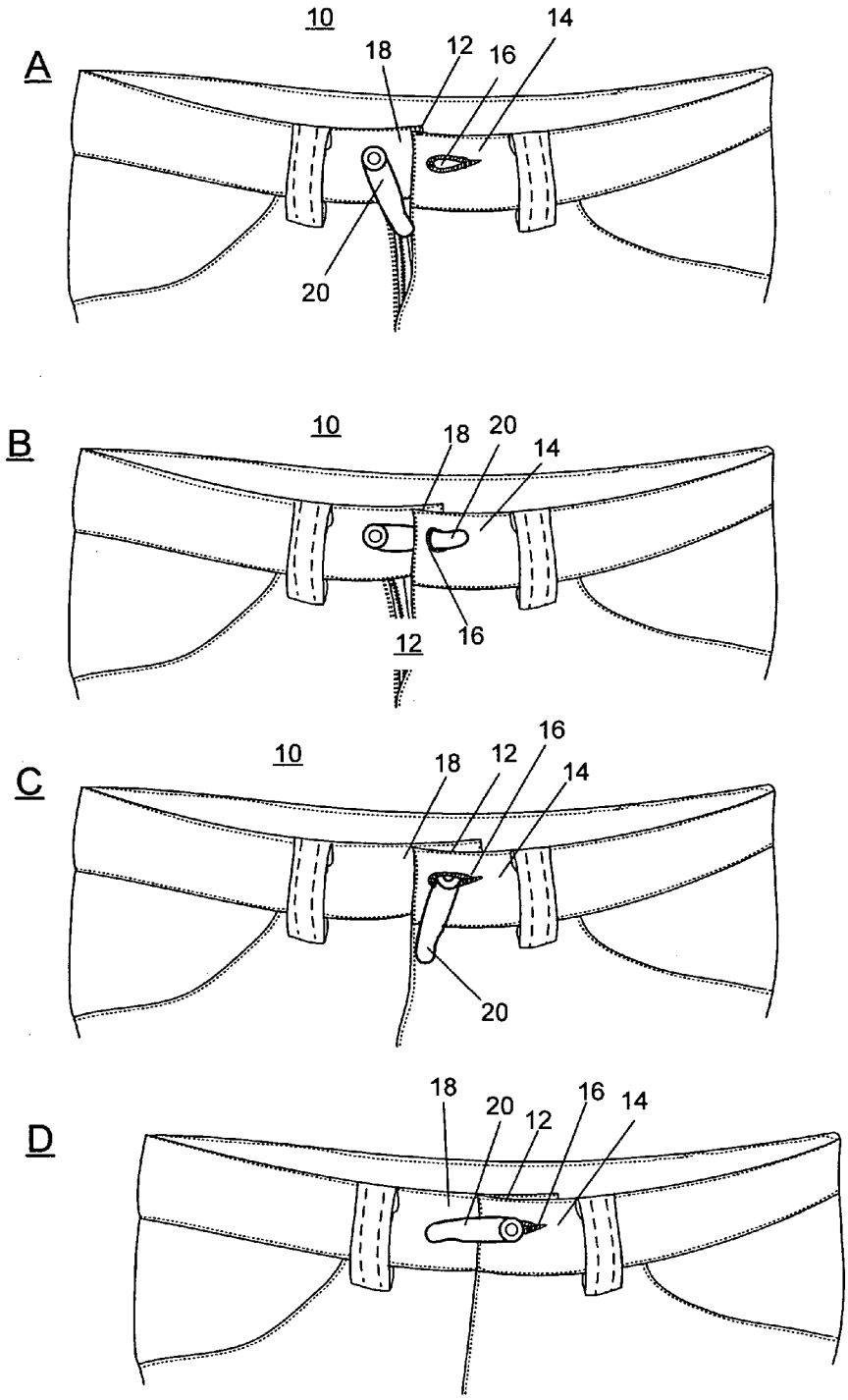
FIG. 1 is a sequential illustration of the operation of the device on an article having an improved closure device, constructed according to the present invention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIGS. 1*a*, 1*b*, 1 *c*, and 1*d*, an article having an improved closure device generally labeled 10 is shown. FIG. 1*a* in particular shows the article having an improved closure device 10 including an opening 12. The opening 12 includes an overlapping portion 14 with a receiving aperture 16 and an underlying surface 18. The article having an improved closure device 10 also includes an asymmetrically offset fastener 20 attached to the underlying surface 16 of the article 10 for fastening the underlying surface 16 to the overlapping portion 14. The asymmetrically offset fastener 20 is preferably dimensionally greater in one direction than in the other direction with respect to the aperture 62.

FIG. 1*b* shows how the asymmetrically offset fastener 20 is inserted into the receiving aperture 16. FIG. 1 *c* shows the asymmetrically offset fastener 20 being pulled through the receiving aperture 16 on the overlapping portion 14 and being rotated in a clockwise or counterclockwise direction in a circular motion to help pull the asymmetrically offset fastener 20 through the aperture 16. The asymmetrically offset fastener 20 may be rotated a full 360 degrees, but a full 360 degree rotation is not necessary to pull the asymmetrically offset fastener 20 through the aperture 16. FIG. 1 *d* shows the article having an improved closure device 10 with the asymmetrically offset fastener 20 after the opening 12 has been closed.

Figure 2A:
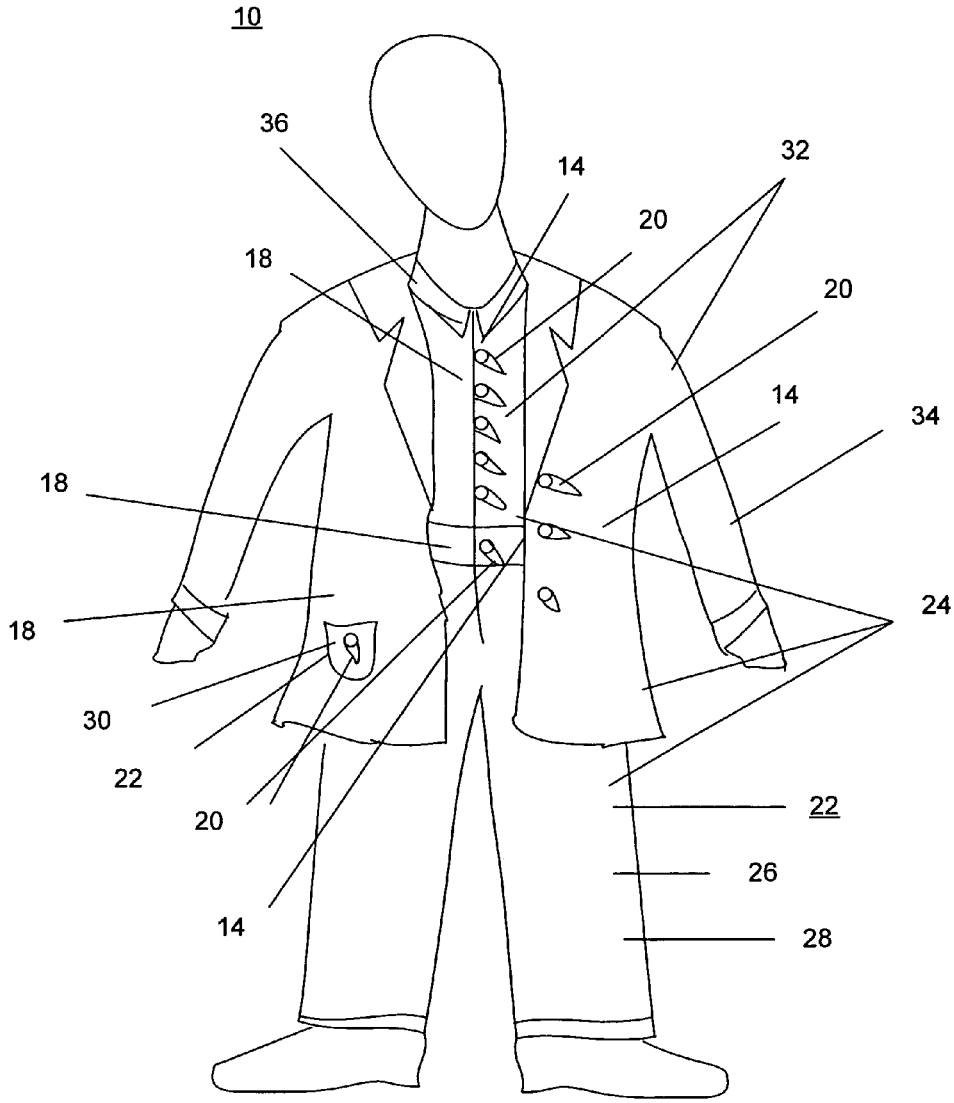
FIGS. 2A-2C show various articles utilizing the present invention.
Figure 2B:
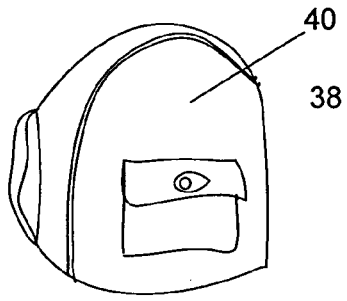
Figure 2C:
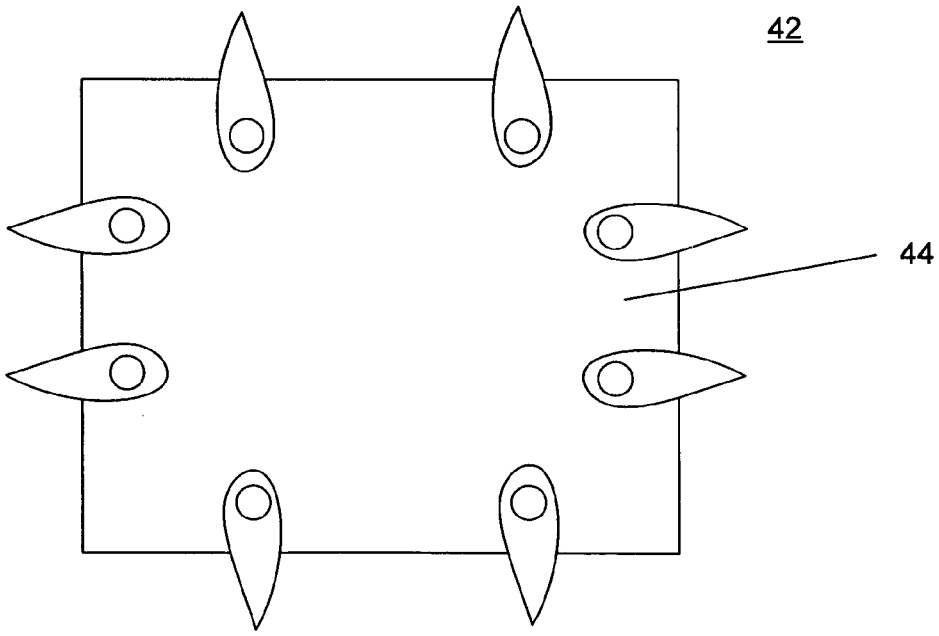

Turning now to FIGS. 2*a*, 2*b*, and 2*c* there is illustrated the shell portion 22 surrounding the article having an improved closure device 10 as best seen in FIG. 1. The shell portion may be a garment 24, as best seen in FIG. 2*a* such as a garment bottom 26. The garment bottom 26 may be a pair of pants 28. The garment 24 may also be a garment top 32, such as a coat 34 or a blouse 36. The shell 22 may also be a pocket 30, a tote 38, or a protective covering 42. The tote 38 may be a book bag 40 as illustrated in FIG. 2*b*. The protective covering 42 may be a tarp 44 as illustrated in FIG. 2*c* for covering boats, cars, etc.

Figure 3:
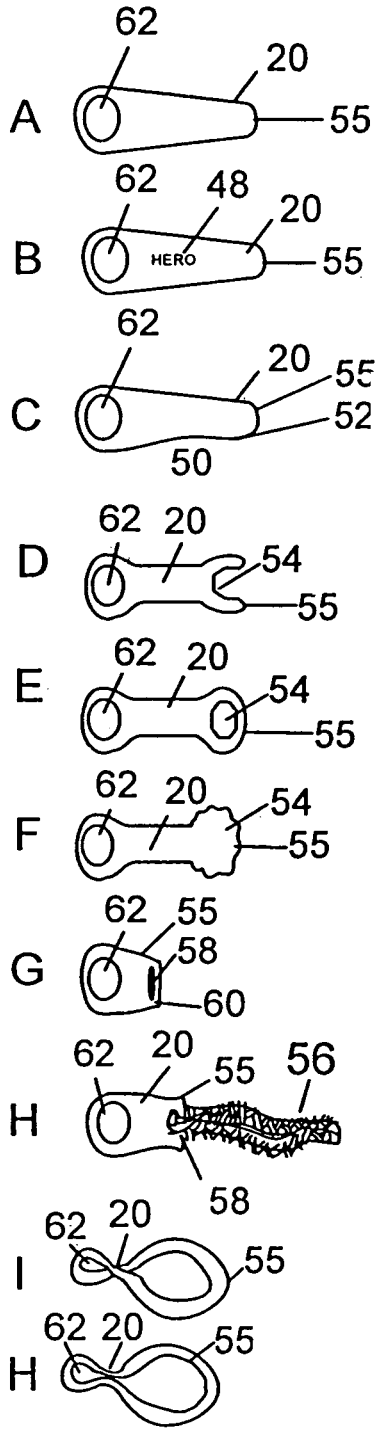
FIG. 3 illustrates various embodiments of the closure device of the present invention.

As best seen in FIGS. 3*a*, 3*b*, 3*c*, 3*d*, 3*e*, 3*f*, 3*g*, 3*g*, 3*i*, and 3*j*, the asymmetrically offset fastener 20 may take on many embodiments. Preferably, the asymmetrically offset fastener 20 is generally egg-shaped as best seen in FIG. 3*a*. The asymmetrically offset fastener 20 may be formed into the shape of a wrench, screwdriver, flower, baseball bat, snake, or other shape. Further, the asymmetrically offset fastener 20 may include indicia 48 on at least one surface of the asymmetrically offset fastener 20 as best seen in FIG. 3*b*. The asymmetrically offset fastener 20 may also include a tactile aid 50 on at least one surface of the asymmetrically offset fastener. The tactile aid 50 may be a notch 52 along one edge of the asymmetrically offset fastener for finger positioning, as best seen in FIG. 3*c*, or a textured surface to aid gripping. The asymmetrically offset fastener 20 may also include a decorative embellishment attached to the distal end 55 such as a colorful flower or a wrench as best seen in FIGS. 3*d*, 3*e*, and 3*f*.

Additionally, the distal end 55 of the asymmetrically offset fastener 20 may also be adapted for receiving a pull 56 as best seen in FIG. 3*h*. The adaptation for receiving a pull 56 may be an aperture 58 or a portion adjacent the distal end 60 as seen in FIG. 3*g*. The aperture 58 may be elongated in the direction perpendicular to the longitudinal axis of the asymmetrically offset fastener. As best seen in FIG. 3*i*, the asymmetrically offset fastener 20 may be constructed in a figure eight shape with a minimal amount of material used for construction. Such an embodiment may be made with wire twisted in the middle to form the figure eight shape. FIG. 3*j* shows another figure eight shaped embodiment of the asymmetrically offset fastener 20 in which the fastener may be formed by pinching wire in the middle to form a figure eight shape.

Figure 4:
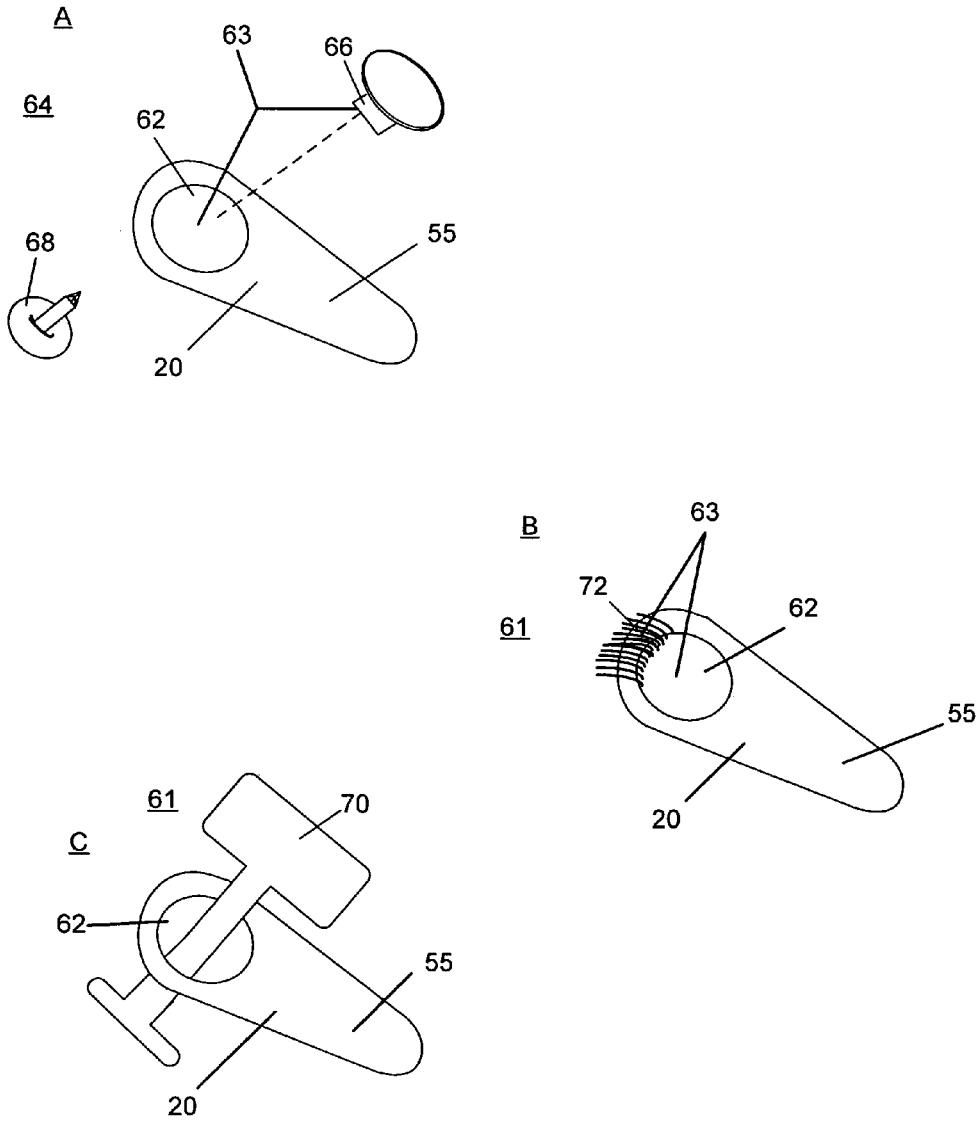
FIG. 4 illustrates various embodiments of attachment devices the closure device of the present invention.

As best seen in FIGS. 4*a*, 4*b*, and 4*c*, the asymmetrically offset fastener 20 may be attached to the underlying surface 18 by an attachment device 61. The attachment device 61, which permanently affixes the asymmetrically offset fastener 20 to the underlying surface 18, may be a male/female attachment 63. The female portion 62 of the "attachment device" 61 is an aperture in the asymmetrically offset fastener. The male portion 64 of the attachment device 61 is a protrusion on the asymmetrically offset fastener 20. The attachment device 61 may be a post 66 and rivet 68 as best seen in FIG. 4*a*. The attachment device 61 may be a plastic tag 70 as best seen in FIG. 4*c*. Also, the attachment device 61 may be by sewing 72 as best seen in FIG. 4*b*. The plastic tag may be attached with a SWIFTACHER® tagging gun manufactured by Dennison Manufacturing Company Corporation Nevada of Pasadena, Calif.

Figure 5:
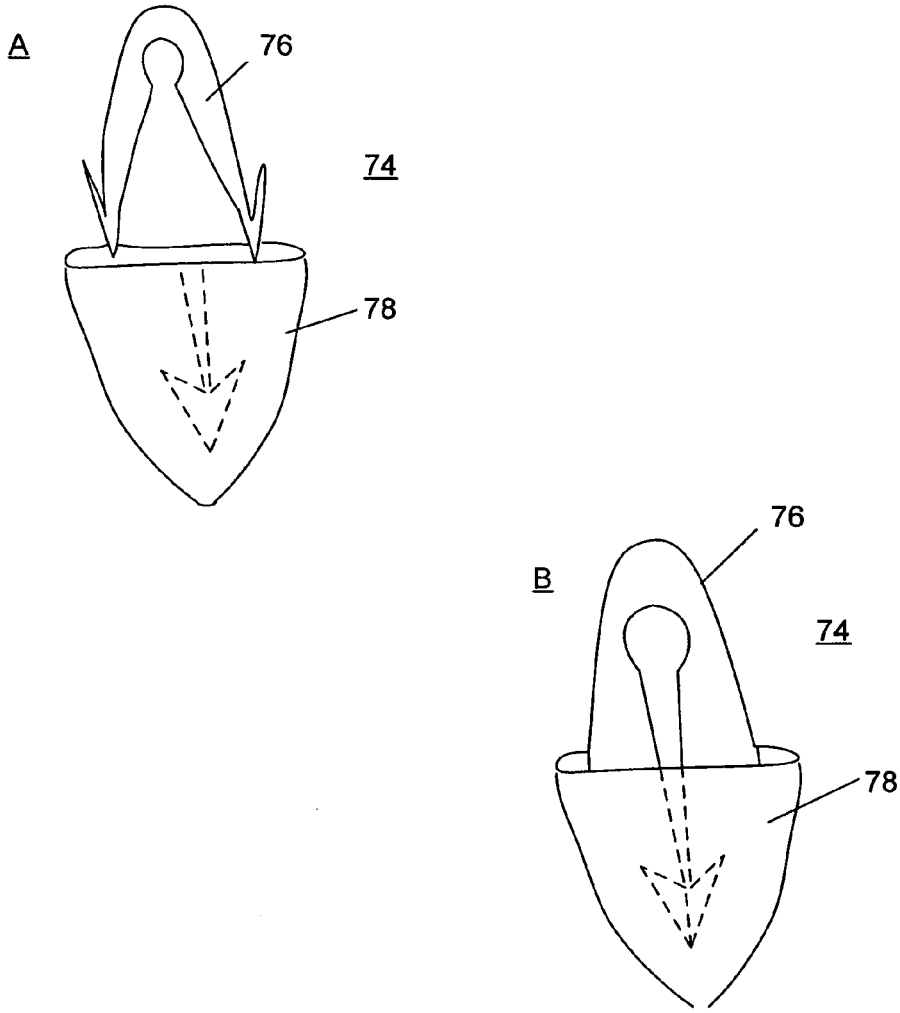
FIG. 5 is a sequential illustration of the operation of a two-piece retro-fit embodiment of the present invention.

As can be seen in FIGS. 5*a* and 5*b*, the asymmetrically offset fastener 20 may be a two-piece fastener 74 adapted to attach to an existing button on the article 10. As best seen in FIG. 5*a*, the two-piece retro-fit fastener 74 includes a split chevron 76 for receiving a button and a sheath 78 for closing the split chevron, thereby permanently affixing the asymmetrically offset fastener 20 to the underlying surface of the article 10. As best seen in FIG. 5*b*, the split chevron 76 snaps into the sheath 78, which locks the chevron 76 into place.

Figure 6:
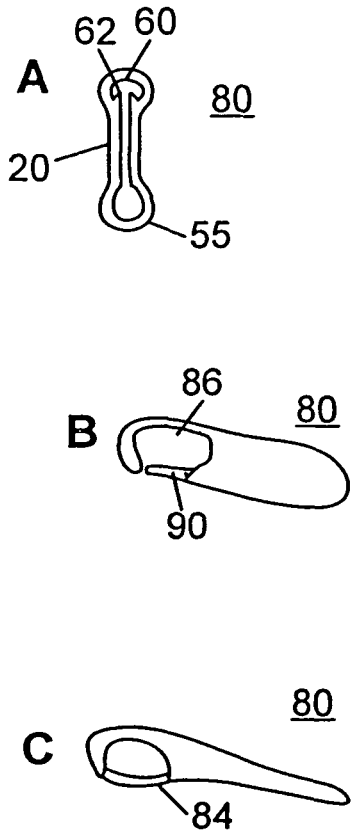
FIGS. 6A-6C are illustrations of one-piece retro-fit embodiments of the present invention.

As best seen in FIGS. 6*a*, 6*b*, and 6*c*, the asymmetrically offset fastener 20 may be a one-piece fastener 80 adapted to attach to an existing button on the article 10. In one embodiment, as best seen in FIG. 6*a*, the one-piece fastener 80 is adapted to attach to an existing button on the article, wherein the one-piece fastener 80 includes an elongated loop 86 with at least one interior locking tab 88 for permanently affixing the asymmetrically offset fastener 20 to the underlying portion 18 of the article having an improved closure device 10. As best seen in FIG. 6*b*, the one-piece fastener 80 includes an elongated loop 86 with at least one exterior locking tab 90 for permanently affixing the asymmetrically offset fastener 20 to the underlying portion 18 of the article having an improved closure device 10. As best seen in FIG. 6*c*, the one-piece fastener 80 includes at least one piece formed with an interior groove 84 adapted to receive an existing button on the article.

Certain modifications and improvements will occur to those skilled in the art upon reading of the foregoing description. By way of example, while in a preferred embodiment the shape of the asymmetrical fastener is roughly egg shaped, other shapes such as an ellipse, dog bone, baseball bat, flower, wrench, snake, teardrop, or any other shape. Further, while the fastener is shown for a shell such as a garment, tote, or protective covering, the fastener may be used in other devices or articles with and overlapping portion and an underlying surface such as tarps, gloves, boat covers, tents, vests, jackets, suspenders, shoes, pocketbooks, or any other article that needs to be fastened. Also, there is no pre-set size for the asymmetrically offset fastener. Thus the fastener may be made in various sizes. Also, the asymmetrically offset fastener may be made with many different materials such as plastic, metal, wood, leather, wire, or other suitable materials. The female portion, which may be an aperture, may be larger or smaller, and only requires a way to permanently affix the asymmetrically offset fastener to the underlying surface. It should be understood that all such modifications and improvements have been deleted herein for the sake of conciseness and readability but are properly within the scope of the following claims.

I claim:

1. An article having an improved closure device comprising:

(a) an opening including: (i) an overlapping portion with a receiving aperture; and (ii) an underlying surface; and (b) an asymmetrically offset fastener permanently affixed and non-removable to the underlying surface of the article for fastening the underlying surface to the overlapping portion, wherein the asymmetrically offset fastener is dimensionally greater in one direction than in the other direction with respect to the aperture.

2. The article according to claim 1, further including a shell portion adjacent to the opening.

3. The article according to claim 2, wherein the shell portion is a garment body.

4. The article according to claim 3, wherein the garment body is a garment bottom.

5. The article according to claim 4, wherein the garment bottom is a pair of pants.

6. The article according to claim 3, wherein the overlapping portion is a pocket.

7. The article according to claim 3, wherein the garment is a garment top.

8. The article according to claim 7, wherein the garment top is a coat.

9. The article according to claim 7, wherein the garment is a blouse.

10. The article according to claim 2, wherein the shell is a tote.

11. The article according to claim 10, wherein the tote is a bookbag.

12. The article according to claim 2, wherein the shell is a protective covering.

13. The article according to claim 12, wherein the protective covering is a tarp.

14. An article having an improved closure device comprising:

(a) an article including: (i) an overlapping portion with a receiving aperture; and (ii) an underlying surface;

(b) an asymmetrically offset fastener permanently affixed and non-removable to the underlying surface of the article for fastening the underlying surface to the overlapping portion, wherein the asymmetrically offset fastener is dimensionally greater in one direction than in the other direction with respect to the aperture; and (c) an attachment device for permanently affixing the asymmetrically offset fastener to the underlying surface of the article.

15. The article according to claim 14, further including indicia on at least one surface of the asymmetrically offset fastener.

16. The article according to claim 14, further including a tactile aid on at least one surface of the asymmetrically offset fastener.

17. The article according to claim 16, wherein the tactile aid is a notch along one edge of the asymmetrically offset fastener for aiding finger positioning.

18. The article according to claim 14, further including a decorative embellishment attached to the distal end of the asymmetrically offset fastener.

19. The article according to claim 14, wherein the distal end of the asymmetrically offset fastener is adapted for receiving a pull.

20. The article according to claim 19, wherein the adaptation for receiving a pull is an aperture.

21. The article according to claim 20, wherein the aperture is elongated in the direction perpendicular to the longitudinal axis of the asymmetrically offset fastener.

22. The article according to claim 19, wherein the adaptation for receiving a pull is a portion adjacent the distal end.

23. The article according to claim 14, wherein the attachment device for permanently affixing the asymmetrically offset fastener to the underlying surface of the article is a male/female attachment.

24. The article according to claim 23, wherein the female portion of the attachment device is an aperture in the asymmetrically offset fastener.

25. The article according to claim 23, wherein the male portion of the attachment device is a protrusion on the asymmetrically offset fastener.

26. The article according to claim 23, wherein the male/female attachment device is a post and rivet.

27. The article according to claim 23, wherein the male/female attachment device is a plastic tag.

28. The article according to claim 23, wherein the male/female attachment device is by sewing.

29. The article according to claim 14, wherein the asymmetrically offset fastener includes at least one piece formed with an interior groove adapted to receive an existing button on the article.

30. The article according to claim 14, wherein the asymmetrically offset fastener is a two-piece fastener adapted to attach to an existing button on the article.

31. The article according to claim 30, wherein the two-piece fastener includes a split chevron for receiving the button and a sheath for closing the split chevron, thereby permanently affixing the asymmetrically offset fastener to the underlying surface of the article.

32. The article according to claim 14, wherein the asymmetrically offset fastener is a one-piece fastener adapted to attach to an existing button on the article.

33. The article according to claim 32, wherein the one-piece fastener includes an elongated loop with at least one interior locking tab for permanently affixing the asymmetrically offset fastener to the underlying surface of the article.

34. The article according to claim 32, wherein the one-piece fastener includes an elongated loop with at least one exterior locking tab for permanently affixing the asymmetrically offset fastener to the underlying surface of the article.

35. An article having an improved closure device comprising:

(a) an article having a garment body including: (i) an overlapping portion with a receiving aperture; and (ii) an underlying surface;

(b) an asymmetrically offset fastener permanently affixed and non-removable to the underlying surface of the article for fastening the underlying surface to the overlapping portion, wherein the asymmetrically offset fastener is dimensionally greater in one direction than in the other direction with respect to the aperture;

(c) an attachment device for permanently affixing the asymmetrically offset fastener to the underlying surface of the article; and (d) a shell portion adjacent to the opening.

36. The article according to claim 35, wherein the shell portion is a garment body.

37. The article according to claim 36, wherein the garment body is a garment bottom.

38. The article according to claim 37, wherein the garment bottom is a pair of pants.

39. The article according to claim 36, wherein the overlapping portion is a pocket.

40. The article according to claim 36, wherein the garment is a garment top.

41. The article according to claim 40, wherein the garment top is a coat.

42. The article according to claim 40, wherein the garment is a blouse.

43. The article according to claim 35, wherein the shell is a tote.

44. The article according to claim 43, wherein the tote is a book bag.

45. The article according to claim 35, wherein the shell is a protective covering.

46. The article according to claim 45, wherein the protective covering is a tarp.

47. The article according to claim 35, further including indicia on at least one surface of the asymmetrically offset fastener.

48. The article according to claim 35, further including a tactile aid on at least one surface of the asymmetrically offset fastener.

49. The article according to claim 48, wherein the tactile aid is a notch along one edge of the asymmetrically offset fastener for aiding finger positioning.

50. The article according to claim 35, further including a decorative embellishment attached to the distal end of the asymmetrically offset fastener.

51. The article according to claim 35, wherein the distal end of the asymmetrically offset fastener is adapted for receiving a pull.

52. The article according to claim 51, wherein the adaptation for receiving a pull is an aperture.

53. The article according to claim 52, wherein the aperture is elongated in the direction perpendicular to the longitudinal axis of the asymmetrically offset fastener.

54. The article according to claim 51, wherein the adaptation for receiving a pull is a portion adjacent the distal end.

55. The article according to claim 35, wherein the attachment device for permanently affixing the asymmetrically offset fastener to the underlying surface of the article is a male/female attachment.

56. The article according to claim 55, wherein the female portion of the attachment device is an aperture in the asymmetrically offset fastener.

57. The article according to claim 55, wherein the male portion of the attachment device is a protrusion on the asymmetrically offset fastener.

58. The article according to claim 55, wherein the male/female attachment device is a post and rivet.

59. The article according to claim 55, wherein the male/female attachment device is a plastic tag.

60. The article according to claim 55, wherein the male/female attachment device is by sewing.

61. The article according to claim 35, wherein the asymmetrically offset fastener includes at least one piece formed with an interior groove adapted to receive an existing button on the article.

62. The article according to claim 35, wherein the asymmetrically offset fastener is a two-piece fastener adapted to attach to an existing button on the article.

63. The article according to claim 62, wherein the two-piece fastener includes a split chevron for receiving the button and a sheath for closing the split chevron, thereby permanently affixing the asymmetrically offset fastener to the underlying surface of the article.

64. The article according to claim 35, wherein the asymmetrically offset fastener is a one-piece fastener adapted to attach to an existing button on the article.

65. The article according to claim 64, wherein the one-piece fastener includes an elongated loop with at least one interior locking tab for permanently affixing the asymmetrically offset fastener to the underlying surface of the article.

66. The article according to claim 64, wherein the one-piece fastener includes an elongated loop with at least one exterior locking tab for permanently affixing the asymmetrically offset fastener to the underlying surface of the article.

67. The article according to claim 1, wherein the permanently affixed and non-removable fastener may be rotated 360 degrees.

68. The article according to claim 1, wherein the permanently affixed and non-removable fastener may be rotated in a clockwise or counterclockwise circular motion to help pull the fastener through the receiving aperture.

69. The article according to claim 1, wherein the permanently affixed and non-removable fastener is attached at only one end.

70. The article according to claim 14, wherein the permanently affixed and non-removable fastener may be rotated 360 degrees.

71. The article according to claim 14, wherein the permanently affixed and non-removable fastener may be rotated in a clockwise or counterclockwise circular motion to help pull the fastener through the receiving aperture.

72. The article according to claim 14, wherein the permanently affixed and non-removable fastener is attached at only one end.

73. The article according to claim 35, wherein the permanently affixed and non-removable fastener may be rotated 360 degrees.

74. The article according to claim 35, wherein the permanently affixed and non-removable fastener may be rotated in a clockwise or counterclockwise circular motion to help pull the fastener through the receiving aperture.

75. The article according to claim 35, wherein the permanently affixed and non-removable fastener is attached at only one end.

* * * * *